US009624784B2

(12) United States Patent
Hafner

(10) Patent No.: US 9,624,784 B2
(45) **Date of Patent: *Apr. 18, 2017**

(54) TURBINE SEAL SYSTEM AND METHOD

(71) Applicant: General Electric Company, Schenectady, NY (US)

(72) Inventor: Matthew Troy Hafner, Greenville, SC (US)

(73) Assignee: General Electric Company, Schenectady, NY (US)

( * ) Notice: Subject to any disclaimer, the term of this patent is extended or adjusted under 35 U.S.C. 154(b) by 845 days.

This patent is subject to a terminal disclaimer.

(21) Appl. No.: 13/937,109

(22) Filed: Jul. 8, 2013

(65) Prior Publication Data

US 2015/0010393 A1 Jan. 8, 2015

(51) Int. Cl.
*F01D 11/00* (2006.01)
*F01D 5/30* (2006.01)

(52) U.S. Cl.
CPC ..... *F01D 11/001* (2013.01); *F01D 5/3015* (2013.01); *F01D 11/003* (2013.01); *F01D 11/005* (2013.01); *F01D 11/006* (2013.01); *F01D 11/008* (2013.01); *Y10T 29/49245* (2015.01)

(58) Field of Classification Search
CPC .... F01D 11/001; F01D 11/003; F01D 11/005; F01D 11/006; F01D 11/008; F01D 5/3015; F05D 2240/55; Y10T 29/49245
USPC ..... 415/173.7
See application file for complete search history.

(56) References Cited

U.S. PATENT DOCUMENTS 3,295,825 A * 1/1967 Hall, Jr. ..... F01D 5/06 415/173.7
3,814,539 A 6/1974 Klompas
4,088,422 A * 5/1978 Martin ..... F01D 5/06 415/173.7
4,582,467 A * 4/1986 Kisling ..... F01D 5/3015 415/115
4,869,640 A * 9/1989 Schwarz ..... F01D 11/001 415/173.7
4,884,950 A 12/1989 Brodell et al.
6,398,488 B1 * 6/2002 Solda ..... F01D 5/081 415/173.7
7,220,099 B2 5/2007 Bekrenev et al.
(Continued)

*Primary Examiner* — Craig Kim
*Assistant Examiner* — Brian P Wolcott
(74) *Attorney, Agent, or Firm* — Fletcher Yoder, P.C.

(57) ABSTRACT

A system includes a multi-stage turbine that includes a first turbine stage having a first wheel having a plurality of first blade segments spaced circumferentially about the first wheel. The turbine also includes a second turbine stage having a second wheel having a plurality of second blade segments spaced circumferentially about the second wheel. The turbine also includes a seal assembly extending axially between the first and second turbine stages. The seal assembly includes a first coverplate coupled to the first turbine stage. The first coverplate includes a first air director. The seal assembly also includes a second coverplate coupled to the second turbine stage. The second coverplate comprises a second air director. The seal assembly also includes an interstage seal. The first coverplate, the second coverplate, or both are configured to support the interstage seal.

20 Claims, 8 Drawing Sheets

(56) References Cited

U.S. PATENT DOCUMENTS

| | | | | |
|---|---|---|---|---|
| 8,845,284 | B2 | 9/2014 | Farrell et al. | |
| 2010/0074732 | A1 * | 3/2010 | Marra | F01D 5/025 415/173.4 |

* cited by examiner

TURBINE SEAL SYSTEM AND METHOD

BACKGROUND

The subject matter disclosed herein relates to gas turbines, and more specifically, to seals within turbines.

In general, gas turbine engines combust a mixture of compressed air and fuel to produce hot combustion gases. The combustion gases may flow through one or more turbine stages to generate power for a load and/or compressor. The combination of hot gases and high pressures can cause stress and wear of components in the turbine. To reduce the stress and wear, cooling gases flow through parts of the turbine, such as the sections between wheels, or the interior of turbine blades. Between each stage, a pressure drop may allow some leakage of the combustion gases to sections designated for cooling gases, or the cooling gases may leak into sections designated for combustion gases. Fluid leakage can reduce the efficiency of the turbine, reduce uniformity between turbines (which can cause uncertainty in a service schedule), or can allow wear of the turbine components, among other problems. Seal assemblies may be disposed between the stages to reduce fluid leakage between stages. Unfortunately, the seals may be subject to stresses, such as thermal stresses, which may bias the seals in axial and/or radial directions, thereby reducing effectiveness of the seals. To reduce the stresses on the seal assemblies, the assemblies may be placed away from the path of the combustion gases. This arrangement, however, may cause additional leakage between the seal assembly and a nozzle that is used to direct the combustion gases. Furthermore, the seal assemblies may extend the distance between turbine stages, which can cause an increase in the overall cost of the turbine.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a multi-stage turbine that includes a first turbine stage having a first wheel having a plurality of first blade segments spaced circumferentially about the first wheel. The turbine also includes a second turbine stage having a second wheel having a plurality of second blade segments spaced circumferentially about the second wheel. The turbine also includes a seal assembly extending axially between the first and second turbine stages. The seal assembly includes a first coverplate coupled to the first turbine stage. The first coverplate includes a first air director. The seal assembly also includes a second coverplate coupled to the second turbine stage. The second coverplate comprises a second air director. The seal assembly also includes an interstage seal. The first coverplate, the second coverplate, or both are configured to support the interstage seal.

In a second embodiment, a method of installing a seal assembly between a first turbine stage and a second turbine stage of a multi-stage turbine includes installing a first coverplate into a first wheel of the first turbine stage and installing a first blade segment around a first circumferential rim of the first wheel. The first blade segment is configured to secure the first coverplate. The method also includes installing a second coverplate into a second wheel of the second turbine stage and installing an interstage seal between the first coverplate and the second coverplate. The first coverplate and the second coverplate are configured to secure the interstage seal. The method also includes installing a second blade segment around a second circumferential rim of the second wheel.

In a third embodiment, a seal assembly for use in a multi-stage turbine includes a first coverplate configured to be coupled to a first turbine stage of a multi-stage turbine. The first coverplate includes a first seal. The seal assembly also includes a second coverplate configured to be coupled to a second turbine stage of the multi-stage turbine. The second coverplate includes a second seal. The seal assembly also includes an interstage seal. The first coverplate, the second coverplate, or both are configured to support the interstage seal.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Figure 1:
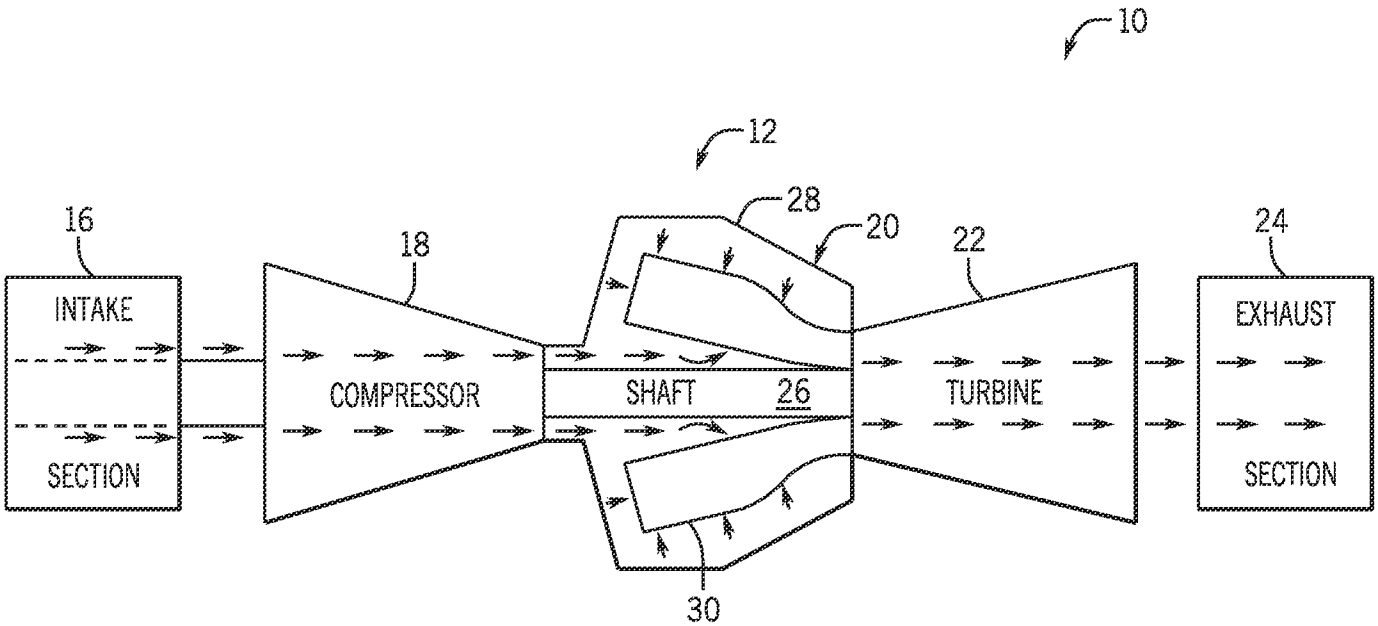
FIG. 1 is a schematic flow diagram of an embodiment of a gas turbine engine that may employ turbine seals.

The present disclosure is directed to gas turbine engines that include interstage seal assemblies, wherein each interstage seal assembly includes seals that are separated from a blade segment of a turbine stage. The separation of the seal from the blade segments may enable the turbine stages to fit closer together in the gas turbine engine. Thus, gas turbine engines that include such interstage seal assemblies may have a shorter overall length and thus, be less costly than engines using other blade segments or seal assemblies. For example, the gas turbine engine may include a first turbine stage that includes a first wheel that has a plurality of first blade segments spaced circumferentially about the first wheel, and a second turbine stage that includes a second wheel having a plurality of second blade segments spaced circumferentially about the second wheel. The interstage seal assembly may extend axially between the first and second turbine stages to seal an interstage gap between the first and second stages. In addition, embodiments of the interstage seal may be installed and removed without disassembling a rotor of the gas turbine engine. For example, the interstage seal assembly may be configured to be installed or removed while the first and second wheels remain in place in the respective first and second turbine stages. Thus, if only the interstage seal assembly is replaced, the rotor of the gas turbine engine is not disturbed, thereby potentially reducing maintenance time, complexity, and/or cost. In some embodiments, the interstage seal assembly may include one or more coverplates configured to enable the interstage seal assembly to be installed in multiple steps or stages. The coverplate may include a seal (different from the interstage seal), such as an angel wing or curved wing, which directs combustion gases, or other fluids, in a desired direction. In contrast to positioning the seal on the blade segment, the disclosed embodiments separate the seal from the blade segment and move the seal to the coverplate to enable the seal to be placed under the blade segment, which in turn enables the turbine stages to be closer together, shortening the overall length of the gas turbine. Additionally, the coverplate may include a sealing element, different from the seal or the interstage seal, which blocks cooling gases from escaping the cooling paths within the gas turbine FIG. 1 is a block diagram of an exemplary system 10 including a gas turbine engine 12 that may employ interstage seal assemblies configured to be installed or removed without rotor disassembly, as described in detail below. In certain embodiments, the system 10 may include an aircraft, a watercraft, a locomotive, a power generation system, or combinations thereof. The illustrated gas turbine engine 12 includes an air intake section 16, a compressor 18, a combustor section 20, a turbine 22, and an exhaust section 24. The turbine 22 is coupled to the compressor 18 via a shaft 26.

As indicated by the arrows, air may enter the gas turbine engine 12 through the intake section 16 and flow into the compressor 18, which compresses the air prior to entry into the combustor section 20. The illustrated combustor section 20 includes a combustor housing 28 disposed concentrically or annularly about the shaft 26 between the compressor 18 and the turbine 22. The compressed air from the compressor 18 enters combustors 30, where the compressed air may mix and combust with fuel within the combustors 30 to drive the turbine 22.

From the combustor section 20, the hot combustion gases flow through the turbine 22, driving the compressor 18 via the shaft 26. For example, the combustion gases may apply motive forces to turbine rotor blades within the turbine 22 to rotate the shaft 26. After flowing through the turbine 22, the hot combustion gases may exit the gas turbine engine 12 through the exhaust section 24. As discussed below, the turbine 22 may include a plurality of interstage seal assemblies, which may be installed or removed while rotary components of the turbine 22, such as wheels, remain in place. Thus, maintenance affecting the interstage seal assemblies may be performed without complete disassembly of the turbine 22.

Figure 2:
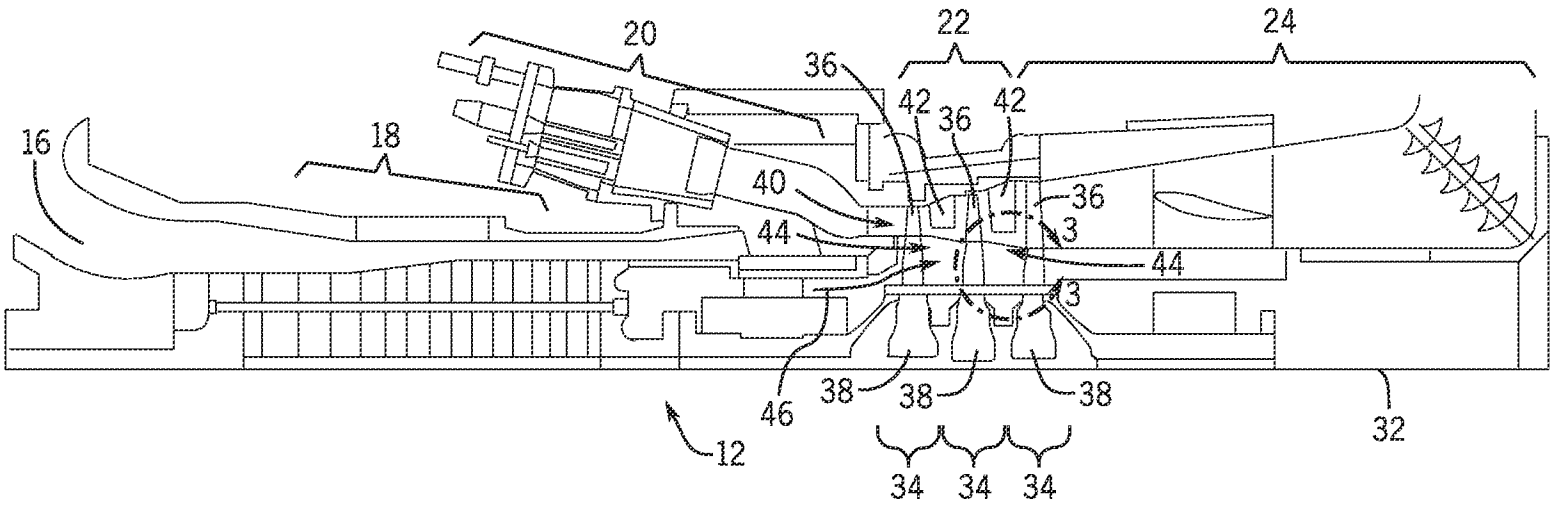
FIG. 2 is a cross-sectional side view of an embodiment of the gas turbine engine of FIG. 1 taken along the longitudinal axis.

FIG. 2 is a cross-sectional side view of an embodiment of the gas turbine engine 12 of FIG. 1 taken along the longitudinal axis 32. As depicted, the gas turbine 22 includes three separate stages 34. Each stage 34 includes a set of blades 36 coupled to a rotor wheel 38 that may be rotatably attached to the shaft 26 (FIG. 1). The blades 36 extend radially outward from the rotor wheels 38 and are partially disposed within the path of the hot combustion gases 40. The combustion gases 40 also flow through stationary nozzles 42 (e.g., stationary blades) that direct the combustion gases 40 against the blades 36, so that the blades 36 may drive the rotor 26 more effectively. Seal assemblies 44 extend between adjacent rotor wheels 38. As discussed below, the seal assemblies 44 may include coverplates that fit about adjacent wheels 38 for support. The coverplates may be configured to block the flow of a cooling fluid 46 that flows along a path on the radially inner side (i.e., closer to the longitudinal axis 32) of the seal assemblies 44. The cooling fluid 46, in some embodiments, may also flow through cooling paths within the blades 36. The interstage seal assemblies 44 may be installed or removed, with the coverplates, while the rotor wheels 38 remain in place in the gas turbine engine 12. Although the gas turbine 22 is illustrated as a three-stage turbine, the seal assemblies 44 described herein may be employed in any suitable type of turbine with a multiple number of stages and shafts. For example, the seal assemblies 44 may be included in a two stage gas turbine, in a dual turbine system that includes a low-pressure turbine and a high-pressure turbine, or in a steam turbine. Further, the seal assemblies 44 described herein may also be employed in an axial compressor, such as the compressor 18. The seal assemblies 44 may be made from various high-temperature alloys, such as, but not limited to, nickel based alloys.

As described above with respect to FIG. 1, air enters through the air intake section 16 and is compressed by the compressor 18. The compressed air from the compressor 18 is then directed into the combustor section 20 where the compressed air is mixed with fuel. The mixture of compressed air and fuel is generally burned within the combustor section 20 to generate high-temperature, high-pressure combustion gases, which are used to generate torque within the turbine 22. Specifically, the combustion gases apply motive forces to the blades 36 to rotate the wheels 38. In certain embodiments, a pressure drop may occur at each stage 34 of the turbine 22, which may allow gas leakage flow through unintended paths. For example, the hot combustion gases 40 may leak into the interstage volume between turbine wheels 38, normally reserved for the cooling fluid 46. This type of leakage may place thermal stresses on the turbine components. Furthermore, flow of hot combustion gases 40 into the interstage volume may abate the cooling effects of the cooling fluid 46. Accordingly, the seal assemblies 44 may be disposed between adjacent wheels 38 to seal and enclose the interstage volume from the hot combustion gases 40.

Figure 3:
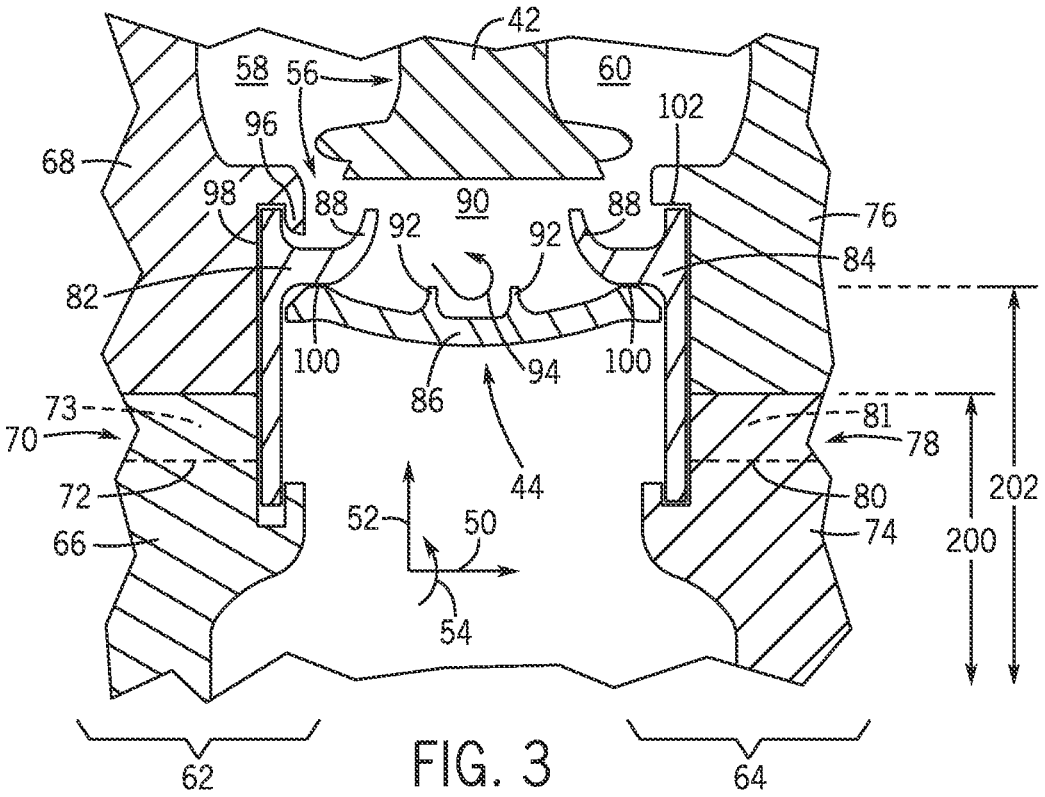
FIG. 3 is a partial cross-sectional side view of the gas turbine engine of FIG. 2 illustrating an embodiment of a seal assembly between turbine stages.

FIG. 3 is a partial cross-sectional side view of the gas turbine engine of FIG. 2 illustrating an embodiment of the seal assembly 44 between turbine stages 34. In the following discussion, reference may be made to an axial direction or axis 50, a radial direction or axis 52, and a circumferential direction or axis 54, relative to the longitudinal axis 32 of the gas turbine engine 12. Hot fluids, such as hot combustion gases 40 or steam, with a flow path 56 (illustrated generally by arrows) enters at an upstream side 58 and exits at a downstream side 60. For illustrative purposes, only a portion of the stages 34 are illustrated in FIG. 3. Specifically, a first turbine stage 62 is shown near the upstream side 58 and a second turbine stage 64 is shown near the downstream side 60. The first turbine stage 62 includes a first wheel 66 with a plurality of first blade segments 68 extending radially outward 52 from a first wheel post portion 70 of the first wheel 66. The first wheel post portion 70 is disposed along the circumference of the first wheel 66 and includes slots 72 (e.g., axial dovetail slots) for retaining lower segments (e.g., axial dovetail tabs 73) of the first blade segments 68. Similarly, the second turbine stage 64 includes a second wheel 74 with a plurality of second blade segments 76 extending radially outward 52 from a second wheel post portion 78 of the second wheel 74. The second wheel post portion 78 is disposed along the circumference of the second wheel 74 and includes slots 80 (e.g., axial dovetail slots) for retaining lower segments (e.g., axial dovetail tabs 81) of the plurality of second blade segments 76. In certain embodiments, approximately 50 to 150 first and second blade segments 68 and 76 may be mounted and spaced circumferentially 54 around the first and second wheels 66 and 74 and a corresponding axis of rotation (extending generally in the direction indicated by arrow 50). In further embodiments, methods other than the slots and tabs described above may be used to couple the first and second blade segments 68 and 76 to the first and second wheels 66 and 74.

The interstage seal assembly 44 includes a first coverplate 82 and a second coverplate 84. The first coverplate 82 is secured within the first turbine stage 62 while the second coverplate 84 is secured within the second turbine stage 64. An interstage seal 86 is positioned between the first coverplate 82 and the second coverplate 84. The interstage seal 86 may be supported by or attached to the first and/or second coverplates 82 and 84, as described in detail below. The seal assembly 44 may include a plurality of coverplates 82, 84 and interstage seals 86, such as 2 to 100 disposed circumferentially 54 adjacent to one another to form a complete 360-degree ring about the longitudinal axis 32 of the gas turbine engine 12. The seal assembly 44 may include equal numbers of coverplates 82, 84 or may include different numbers of first coverplates 82 and second coverplates 84. Similarly, the interstage seal assembly 44 may include a different number of interstage seals 86 than either first coverplates 82 or second coverplates 84. Each of the components (82, 84, 86) of the interstage seal assembly 44 is arcuate in the circumferential direction 54.

As illustrated, the first coverplate 82 and the second coverplate 84 include a seal 88 that directs the combustion gases 56 away from a gap 90 between the interstage seal 86 and the nozzle 42. During operation of the turbine engine 12, the stages 34 rotate in the circumferential direction 54 while the nozzles 42 remain stationary. Thus, the interstage seal 86 and the nozzle 42 are not connected to one another, thereby creating the gap 90. Combustion gases 56 may flow through the gap 90, and the flow of combustion gases 56 is greater when the gap 90 is wider. Reducing the size of the gap 90, however, may take precise calibration which can be labor and time intensive. Thus, it is desirable to minimize the flow of combustion gases 56 through the gap 90 in other ways. Seals 88, such as angel wings or curved wings, may be used to direct combustion gases 56 away from the gap 90, reducing the flow therethrough. As discussed below, the disclosed embodiments attach the seal 88 to the coverplates 82 and 84, rather than placing the seal (e.g., an angel wing) on a component that includes the blade (e.g., blade segments 68, 76). Thereby helping to reduce the distance between turbine stages 34 and decrease overall length of the turbine engine 12. Attaching the seal 88 to the coverplates 82 and 84 can reduce the length of the turbine engine 12 due to the shorter distance that the bucket uses to slide out of the wheel during removal. The interstage seal 86 may also include seal teeth 92 directed at the gap 90 and the nozzle 42. The seal teeth 92 reduce the flow speed of combustion gases 56 through the gap 90. The seal teeth 92 create a flow path 94 that breaks up any straight-line path that the combustion gases 56 may otherwise travel. In other words, the seal teeth 92 may create a tortuous path for the combustion gases 56.

As described in detail below, the first blade segment 68 may include a hook 96 that is configured to couple the first coverplate 82 to an inner edge 98 of the first blade segment 68. The hook 96 holds the first coverplate 82 in place during operation of the turbine engine 12 and during installation of the interstage seal assembly 44. The first coverplate 82 and the second coverplate 84 may also hold the interstage seal 86 in place. During operation of the turbine engine 12, the seal assembly 44 rotates in the circumferential direction 54, which causes radial 52 forces on the interstage seal 86 which in turn forces the interstage seal 86 to engage the coverplates 82, 84 tightly at engagement points 100. The interstage seal 86 may also attach to the coverplates 82, 84 at the engagement points 100. The attachment may be through physical, mechanical, chemical, or other means including examples described below. This configuration enables the interstage seal 86 to engage the coverplates 82, 84 at a greater radial 52 distance than would otherwise be practical. For example, rather than engaging the coverplates 82, 84 at a radial 52 distance that is less than the radius 200 of the turbine wheel 66, 74, the interstage seal 86 may engage at the engagement points 100 which are positioned at attachment radius 202. In the illustrated embodiment, the engagement points 100, are radially 52 outside the point where the first wheel 66 meets the first blade segment 68 and outside the point where the second wheel 74 meets the second blade segment 76. This enables a more efficient flow of combustion gases 56 and also blocks the cooling fluid 46 from entering the path of the combustion gases 56.

In some embodiments, the attachment may not be a rigid attachment such that the interstage seal 86 may freely respond to growth that occurs due to thermal expansion. The engagement causes the coverplates 82, 84 to load into the blade segments 68, 76 such that the seal assembly 44 remains secure as it rotates with the turbine engine 12. The seal assembly 44, in some embodiments, may use the hook 96 only on one side of the assembly. In other words, it is possible that the second blade segment 76 does not include a hook on the outer edge 102 where it meets the second coverplate 84, as shown in FIG. 3. Instead, engagement with the interstage seal 86 may be used to hold the second coverplate 84 in place.

Figure 4:
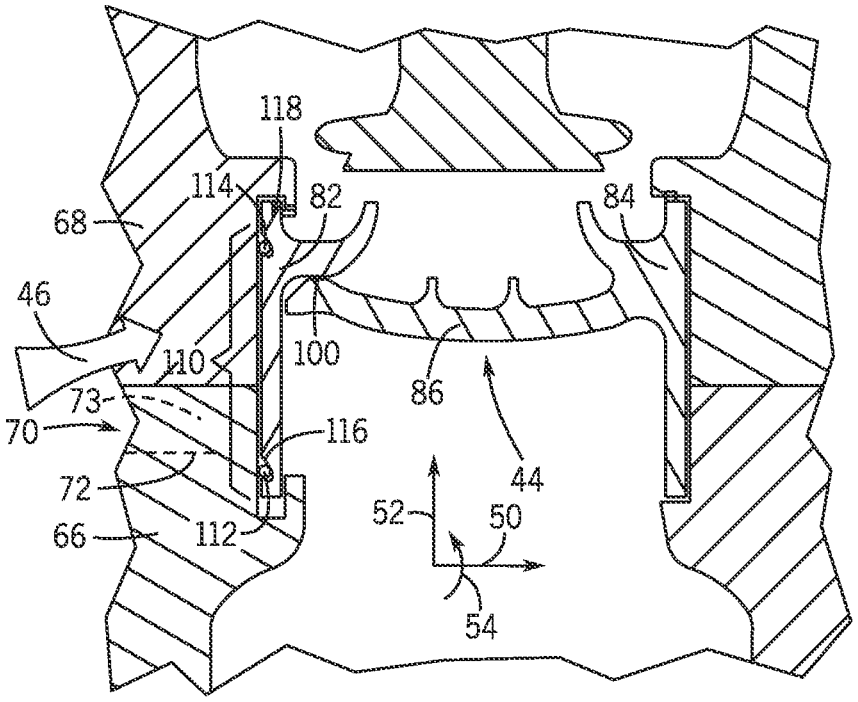
FIG. 4 is a partial cross-sectional side view of the gas turbine engine of FIG. 2 illustrating an embodiment of a seal assembly between adjacent stages.

FIG. 4 is a partial cross-sectional side view of the gas turbine engine of FIG. 2 illustrating an embodiment of the seal assembly 44 between turbine stages 34. The seal assembly 44 illustrated includes an interstage seal 86 that is integrally formed with the second coverplate 84. Whereas the seal assembly 44 of FIG. 3 included three separate components engaged at engagement points 100, the seal assembly 44 of FIG. 4 includes two components: the first coverplate 82 and the second coverplate 84/interstage seal 86 combination. This configuration may be easier to install within the system 10 as the number of components to install is reduced. Also, manufacturing two components may be cheaper and/or easier, thus saving cost overall of the system 10. The interstage seal 86 may engage with the first coverplate 82 at the engagement point 100 as described with regard to FIG. 3.

FIG. 4 also illustrates an embodiment of a forward sealing element 110 that may be included with the first coverplate 82. FIG. 4 shows the first coverplate 82 installed within the first stage 62 described above. It will be appreciated that the sealing element 110 may be segmented (e.g., multiple segments in the circumferential 54 direction) like the other components of the seal assembly 44. Multiple components may form the sealing element 110, so that it encompasses 360 degrees of the turbine stage (e.g., turbine stage 34). The coverplate 82 includes a radially 52 inner seal structure 112 and a radially 52 outer seal structure 114. Collectively, the inner seal structure 112 and the outer seal structure 114 form the sealing element 110. The sealing element 110 may be installed on either coverplate 82, 84 of the seal assembly 44. If installed on the first coverplate 82, the sealing element 110 may be the forward sealing element. If installed on the second coverplate 84, the sealing element 110 may be the aft sealing element. The inner seal structure 112 may be disposed radially 52 closer to the longitudinal axis 32 than the outer seal structure 114. In certain embodiments, the inner seal structure 112 may be disposed within an inner notch 116 while the outer seal structure 114 is disposed within an outer notch 118, either or both of which may be an indentation or other recessed portion within the coverplate 82. Each of the inner seal structure 112 or the outer seal structure 114 may be a metal wire coated in ceramic thermal insulation, a metal wire without ceramic insulation, or some other thermally insulating seal that is configured to fit within the notch 116, 118 on the coverplate 112.

The sealing element 110 may be configured to block the flow of cooling fluid 46 as it flows through the blade segment 68 and around the wheel 66. As explained above with regard to FIG. 2, cooling fluid 46 may flow through the turbine engine 12 to lower the temperature of certain components. The efficiency and/or durability of the turbine components may be adversely affected if the cooling fluid 46 escapes designated paths. For example, the cooling fluid 46 may flow around the dovetail tabs 73 that are fitted within the slots 72. To block this flow, inner seal structure 112 and/or outer seal structure 114 form a barrier around the area from which the cooling fluid 46 may flow. For example, the inner seal structure 112 may be configured to block the flow of cooling fluid 46 between the first coverplate 82 and the first wheel 66. The outer seal structure 114 may be configured to block the flow of cooling fluid 46 between the first coverplate 82 and the first blade segment 68. Installation of the sealing element 110 may occur concurrent with the installation of the first coverplate 82, or it may be installed within the coverplate notches 112, 114 before the first coverplate 82 is installed.

Figure 5:
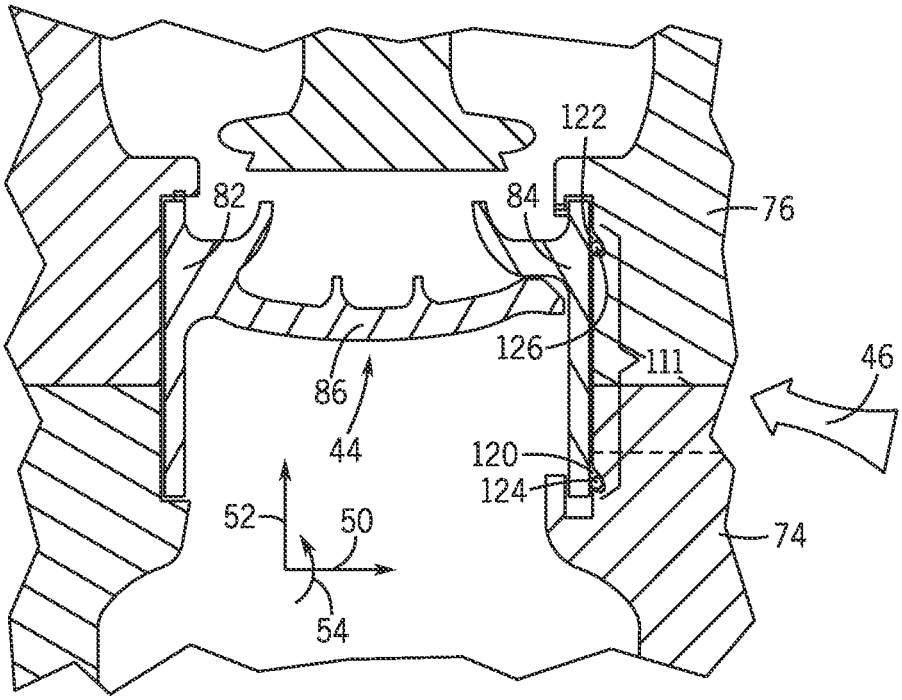
FIG. 5 is a partial cross-sectional side view of the gas turbine engine of FIG. 2 illustrating an embodiment of a seal assembly between adjacent stages.

FIG. 5 is a partial cross-sectional side view of the gas turbine engine of FIG. 2 illustrating an embodiment of the seal assembly 44 between turbine stages 34. The illustrated seal assembly 44 includes an interstage seal 86 that is integrally formed with the first coverplate 82. The seal assembly 44 of FIG. 5 includes two components: the second coverplate 84 and the first coverplate 82/interstage seal 86 combination. Again, a configuration with only two components may be easier to install within the gas turbine engine 12 as there are fewer parts. The interstage seal assembly 44 may be segmented for ease of installation and replacement. Also, this configuration may be more cost efficient as the combination 82/86 may be manufactured together. The interstage seal 86 may engage with the second coverplate 84 at the engagement points 100 as described with regard to FIG. 3.

FIG. 5 also illustrates an embodiment of an aft sealing element 111 installed with the second coverplate 84. The second coverplate 84 with the sealing element 111 may be installed within any turbine stage 34 as part of the seal assembly 44. The second coverplate 84 may also form a barrier around the area from which the cooling fluid 46 may flow. The second coverplate 84 in FIG. 5 illustrates that an inner notch 120 and an outer notch 122 may be formed in the second wheel 74 and the second blade segment 76, respectively. The inner seal structure 124 and/or outer seal structure 126 may, as described in regards to FIG. 4, form a barrier around the area from which the cooling fluid 46 may flow. With the notches 120, 122 formed in the wheel 74 and blades segment 76, respectively, the inner seal structure 124 the outer seal structure 126 may form a continuous circular structure even when the second coverplate 84 is segmented. This may reduce the time it takes to install the seal assembly 44 by eliminating the time otherwise needed to install each individual seal structure 124, 126 into each individual coverplate 84. In other embodiments, the seal structures 124, 126 may be segmented. For example, the seal structures 124, 126 may be segmented to correspond to the segmentation of the second coverplate 84. The embodiments illustrated in FIG. 4 and FIG. 5 may also be used in combination. That is, the second wheel 74 may have one notch (e.g., notch 124) while the coverplate has another notch (e.g., notch 114). Also, the second blade segment 76 may have one notch (e.g., notch 126) while the second coverplate 84 has another notch (e.g., 116). Furthermore, as stated above, the seal assembly 44 may include the forward sealing element 110 and the aft sealing element 111.

Figure 6:
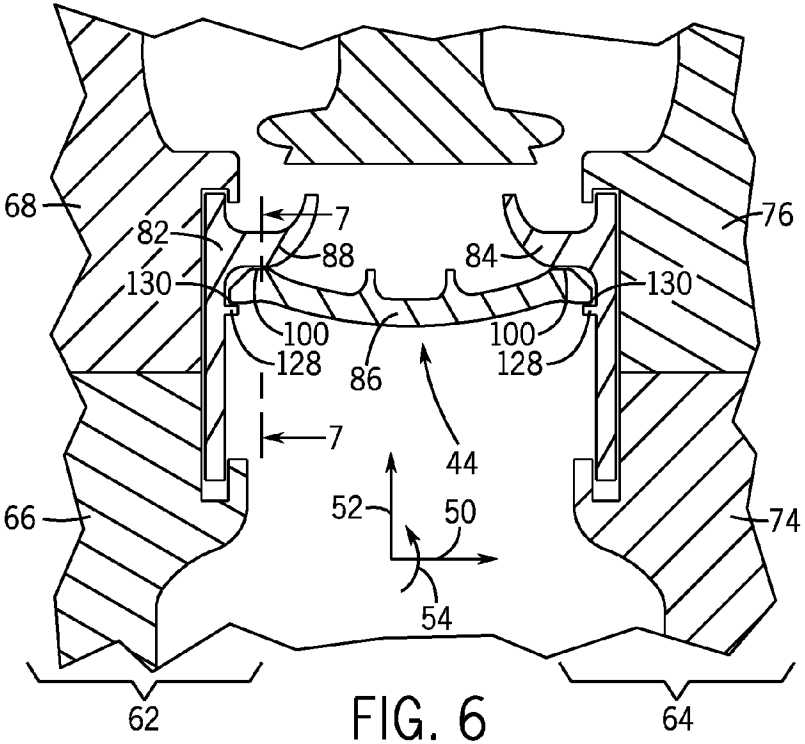
FIG. 6 is a partial cross-sectional side view of the gas turbine engine of FIG. 2 illustrating an embodiment of the seal assembly between turbine stages.
Figure 7:
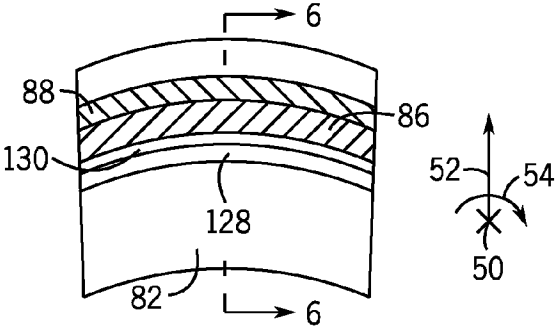
FIG. 7 is a partial cross-sectional front view illustrating an embodiment of a coverplate of FIG. 6, taken along line 7-7 of FIG. 6.

FIG. 6 is a partial cross-sectional side view of the gas turbine engine of FIG. 2 illustrating an embodiment of the seal assembly 44 between turbine stages 34. As illustrated, the seal assembly 44 is installed between the first stage 62 and the second stage 64. As described above, the first stage 62 includes the first coverplate 82, the first wheel 66, and the first blade segment 68. The second stage 64 includes the second coverplate 84, the second wheel 74, and the second blade segment 76. The seal assembly 44 also includes the interstage seal 86 engaged with the first coverplate 82 and second coverplate 84 at the engagement points 100. The first coverplate 82 and the second coverplate 84 include a lip 128 that supports the interstage seal 86 across the bottom edge 130. The lip 128 may extend along the circumferential length of the interstage seal 86 as shown in FIG. 7, which represents a partial cross-sectional front view of the first coverplate 82 taken along the line labeled 7-7 of FIG. 6. Correspondingly, the partial cross-sectional side view of FIG. 6 is indicated along the line labeled 6-6 in FIG. 7. The lip 128 in other embodiments may extend only partially or intermittently (e.g., see FIG. 9 ) across the circumferential length of the interstage seal 86. In other words, the lip 128 may include two, three, four, or more lips along an edge 130 of the interstage seal 86. Furthermore, some embodiments may have the lip 128 only on the first coverplate 82 or only on the second coverplate 84. The lip 128 as shown in FIG. 6 may improve the speed of installation and/or may decrease the cost of the seal assembly 44. For example, the interstage seal 86 may wear out differently than the first coverplate 82 or the second coverplate 84. In the embodiment shown in FIG. 6, each component 82, 84, 86 of the seal assembly 44 may be replaced independently of the others, thereby saving time and costs associated with servicing and parts replacement.

Figure 8:
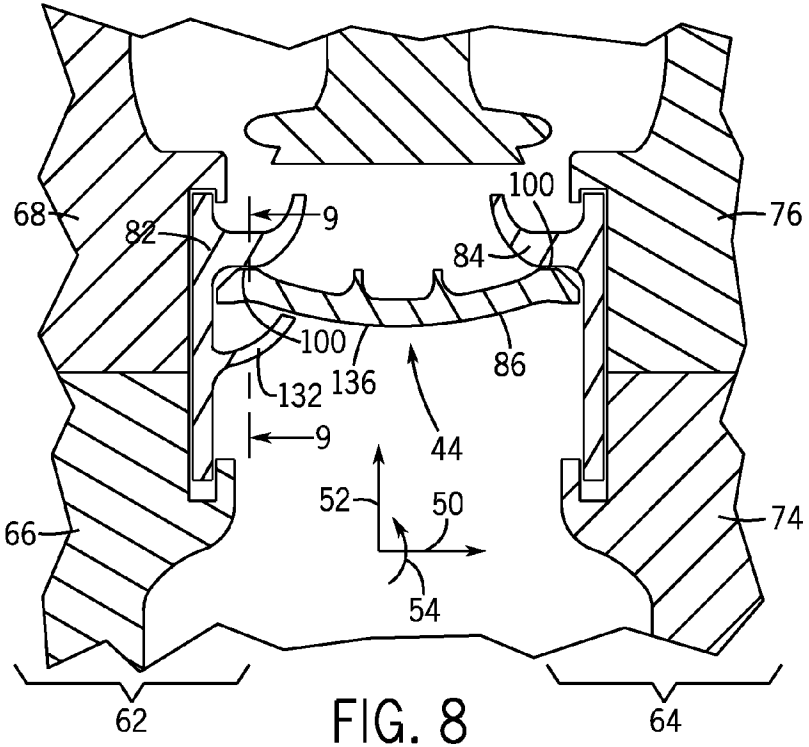
FIG. 8 is a partial cross-sectional side view of the gas turbine engine of FIG. 2 illustrating an embodiment of the seal assembly between turbine stages.
Figure 9:
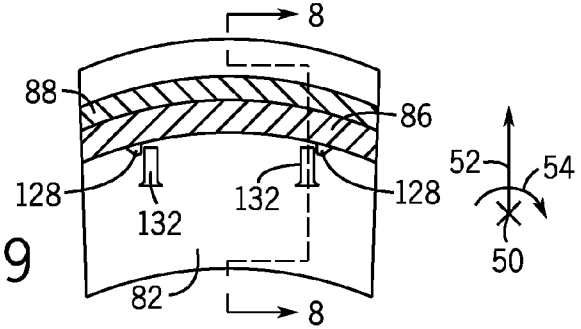
FIG. 9 is a partial cross-sectional front view illustrating an embodiment of a coverplate of FIG. 8, taken along line 9-9 of FIG. 8.

FIG. 8 is a partial cross-sectional side view of the gas turbine engine of FIG. 2 illustrating an embodiment of the seal assembly 44 between turbine stages 34. As illustrated, the seal assembly 44 is installed between the first stage 62 and the second stage 64. As described above, the first stage 62 includes the first coverplate 82, the first wheel 66, and the first blade segment 68. The second stage 64 includes the second coverplate 84, the second wheel 74, and the second blade segment 76. The seal assembly 44 also includes the interstage seal 86 engaged with the first coverplate 82 and second coverplate 84 at the engagement points 100. As illustrated, the first coverplate 82 includes support arms 132 that support the interstage seal 86 across the bottom side 136. The support arms 132 may extend outward from the first coverplate 82 from multiple locations as shown in FIG. 9, which represents a partial cross-sectional front view of the first coverplate 82 taken along the line labeled 9-9 of FIG. 8. Correspondingly, the partial cross-sectional side view of FIG. 8 is indicated along the line labeled 8-8 in FIG. 9. FIG. 9 shows two support arms 132, but in other embodiments the first coverplate 82 may include one, three, or more support arms 132. The support arms 132 may provide more substantial support for the interstage seal 86; this may be useful over other embodiments if the interstage seal 86 is manufactured from a heavy material, or if the lip 128 from FIG. 6 does not support the thermal expansion and contraction of the interstage seal 86 during operation of the gas turbine engine 12.

Figure 10:
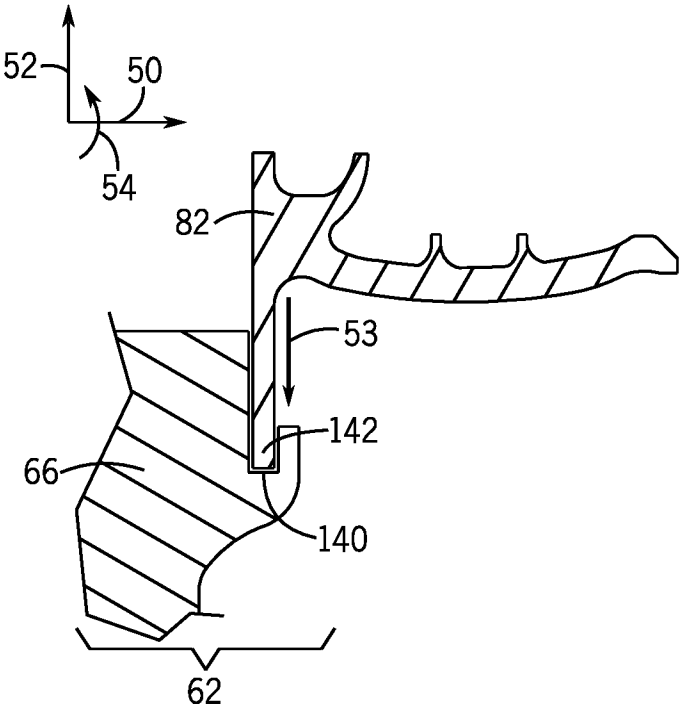
FIG. 10 is a partial cross-sectional side view of the gas turbine engine of FIG. 2 illustrating an embodiment of a seal assembly being installed between adjacent stages.

FIG. 10 is a partial cross-sectional side view of the gas turbine engine of FIG. 2 illustrating an embodiment of the seal assembly 44 being installed between adjacent stages 62. As illustrated, the first stage 62 includes the first wheel 66 without the first blade segment 68. It will be appreciated that the installation process may begin with either the first stage 62 (as illustrated) or the second stage 64. Each blade segment 68, 76 may be removed from the first stage 62 and the second stage 64 as part of a servicing or other procedure. The first wheel 66 includes a slot at a circumferential rim 140, which is empty following the service procedure and before the installation process starts. In other embodiments, the first wheel 66 may lack a slot at the circumferential rim 140. As illustrated in FIG. 10, the first coverplate 82 is installed into the slot at the circumferential rim 140 in the direction 53 opposite the radial direction 52. As illustrated, the interstage seal 86 and the first coverplate 82 may be integrally connected (e.g., one-piece structure). A lower end 142 of the first coverplate 82 fits relatively securely into the slot at the circumferential rim 140, which may hold the first coverplate 82 in place without additional support. As shown, the lower end 142 is inserted completely into the bottom of the slot at the circumferential rim 140. Thus, FIG. 8 may represent a first step in the assembly of the seal assembly 44 in the gas turbine engine 12.

Figure 11:
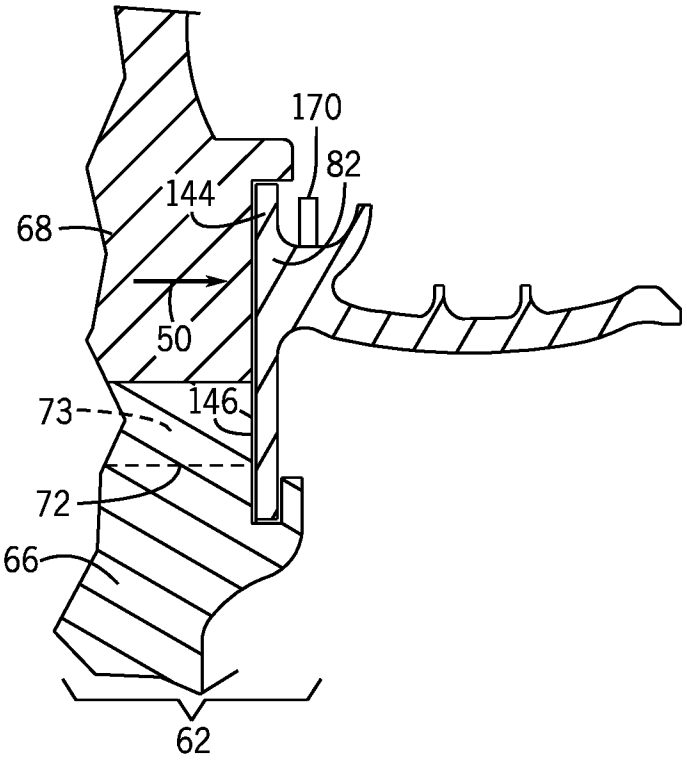
FIG. 11 is a partial cross-sectional side view of the gas turbine engine of FIG. 2 illustrating an embodiment of a seal assembly being installed between adjacent stages.

FIG. 11 is a partial cross-sectional side view of the gas turbine engine of FIG. 2 illustrating an embodiment of the seal assembly 44 being installed between adjacent stages 62. Specifically, FIG. 11 may represent a second step in the assembly of the seal assembly 44 in the gas turbine engine 12. It may be understood that the assembly of the seal assembly 44 may start with the installation of the second coverplate 84 in the second stage 64; no limitation is intended as to the order of the assembly. As shown, after the first coverplate 82 is installed in the slot at the circumferential rim 140, as shown in FIG. 11, the first blade segment 68 slides in the axial direction 50 into place around the outside of the first wheel 66. An inner edge 144 of the first blade segment 68 is even with (e.g., adjacent to) an inner edge 146 of the first wheel 66. As explained in detail above with regard to FIGS. 4 and 5, the first coverplate 82 is configured to block cooling fluid 46 from seeping through the slot 72 around the tab 73. The hook 96 on the edge of the blade segment 68 is configured to slide over or past the top of the first coverplate 82 while the first coverplate 82 is inserted into the bottom of the slot at the circumferential rim 140. In other embodiments, the blade segment 68 lacks a hook 96 such that it may circumferentially attach the coverplate 82 by sliding over the top of the coverplate 82 without any extra space in the radial 52 direction.

Figure 12:
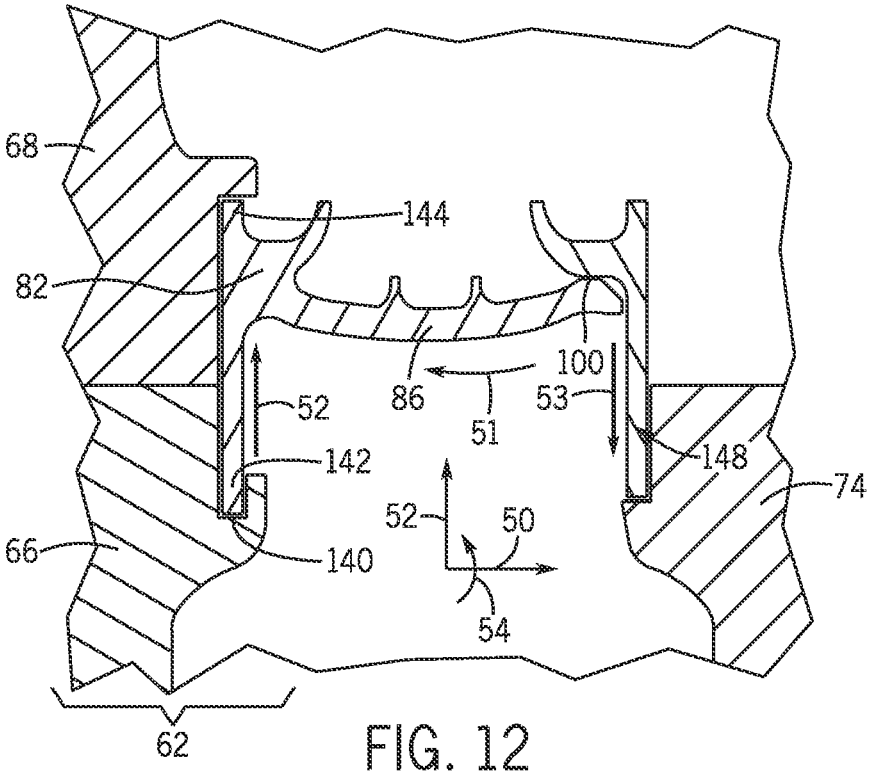
FIG. 12 is a partial cross-sectional side view of the gas turbine engine of FIG. 2 illustrating an embodiment of a seal assembly being installed between adjacent stages.

FIG. 12 is a partial cross-sectional side view of the gas turbine engine of FIG. 2 illustrating an embodiment of the seal assembly 44 being installed between adjacent stages 62. Specifically, FIG. 12 may represent a third step in the assembly of the seal assembly 44 in the gas turbine engine 12. After the first blade segment 68 is secured into place above the first wheel 66, the second coverplate 84 is installed. The interstage seal 86 may hold the second coverplate 84 outward in the radial direction 52 at the engagement point 100. The second coverplate 84 is installed into a recess 148 of the second wheel 74. As illustrated, the recess 148 does not include the slot at the circumferential rim 140 shown in the first stage 62. The recess 148 may include a slot if required to constrain the seal plate during operation.

Figure 13:
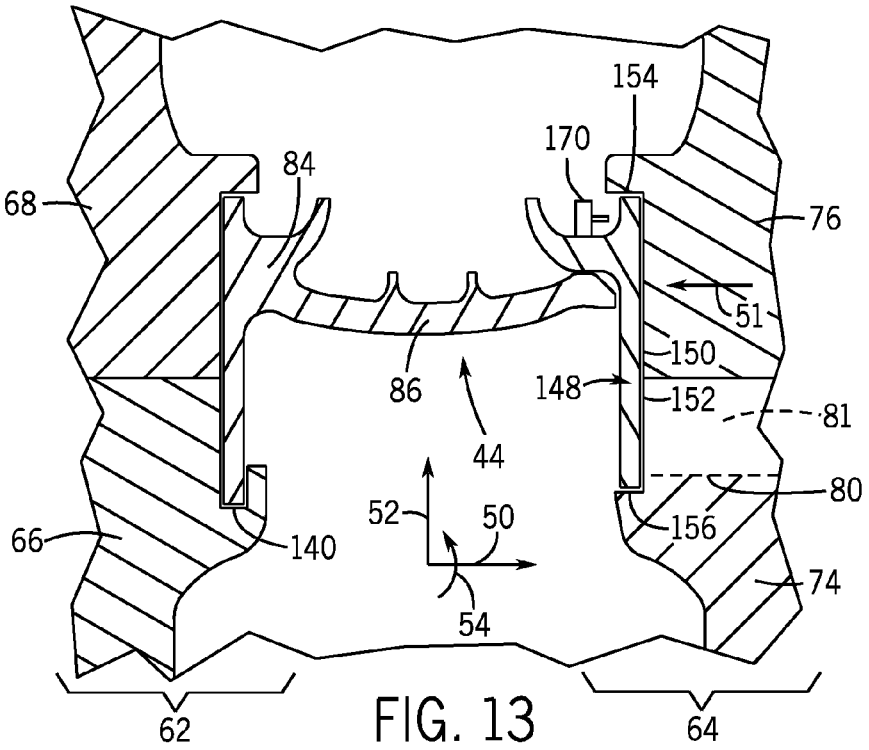
FIG. 13 is a partial cross-sectional side view of the gas turbine engine of FIG. 2 illustrating an embodiment of a seal assembly being installed between adjacent stages.

FIG. 13 is a partial cross-sectional side view of the gas turbine engine of FIG. 2 illustrating an embodiment of the seal assembly 44 being installed between adjacent stages 62. The final step in installing the interstage assembly 44 is to install the second blade segment 76 around the circumferential rim 156 of the second wheel 74. The second blade segment 76 may be installed in the direction 51 that is opposite the axial direction 50 and the dovetail tab 81 is secured within the slot 80. The second blade segment may also be installed using a circumferential attachment. An inside edge 150 of the second blade segment 76 is even with an inside edge 152 of the second wheel 74, and the second coverplate 84 is flush against the inside edges 150, 152. The second coverplate 84 may fit into the recess 148 without extra space on the top and bottom of the coverplate 84. In other words, the second blade segment 76 and the second wheel 74 may help block excessive relative radial 52 movement of the second coverplate 84. As illustrated in FIG. 13, the second coverplate 84 may be secured and supported in the recess 148 by the interstage seal 86. To clarify, the outer edge 154 of the recess 148 may not have the hook 96 shown in the first stage 62, and the circumferential rim 156 may not have the slot at the circumferential rim 140 shown in the first stage 62. This arrangement may enable faster assembly and/or reduced cost of the turbine engine 12. In other embodiments, the second stage 64 may include the slot at the circumferential rim 140 and the hook 96. In still further embodiments, the first stage 62 and the second stage 64 may both lack the slot at the circumferential rim 140 and the hook 96 as illustrated by the second stage 64 in FIG. 13. The foregoing steps may be modified to accommodate the other embodiments disclosed herein. For example, for embodiments that include three separate components (e.g., first coverplate 82, second coverplate 84, and a separate interstage seal 86) the interstage seal 86 may be installed during the third step illustrated by FIG. 12.

Figure 14:
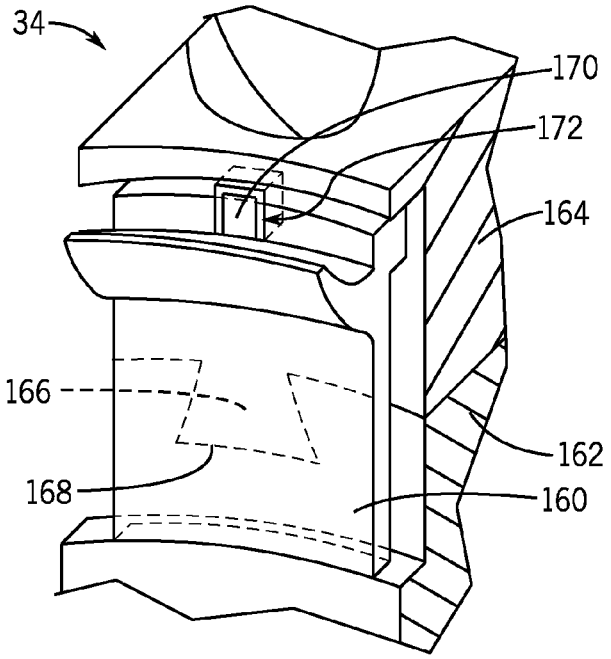
FIG. 14 is a perspective view of an embodiment of an anti-rotation tab installed in a coverplate of the gas turbine engine of FIG. 2.

FIG. 14 is a perspective view of an embodiment of an anti-rotation tab installed in a coverplate (e.g., first or second coverplate 82, 84) of the gas turbine engine of FIG. 2. A coverplate 160 in FIG. 14 represents either the first coverplate 82 or the second coverplate 84 and may be installed in any turbine stage 34 as part of a seal assembly 44. The turbine stage 34 includes wheel 162 and blade segment 164 that are connected by the dovetail tab 166 fitted within the slot 168. The seal assembly 44 may include an anti-rotation tab 170. The anti-rotation tab 170 may be integrally formed with the coverplate 160 or may be integrally formed with the blade segment 164, or may be a separate component. As illustrated, the anti-rotation tab 170 is integrally formed with the coverplate 160 and disposed within an anti-rotation slot 172 through the front of the blade segment 164. The anti-rotation slot 172 in some embodiments may extend only partially through the blade segment 164.

The anti-rotation tab 170 is configured to block circumferential 54 movement of the coverplate 160 with respect to the wheel 162 and the blade segment 164. It will be understood that all pieces of the seal assembly 44 (wheel 162, blade segment 164, coverplate 160, and anti-rotation tab 170) rotate in the circumferential direction 54 (or in the opposite direction), but the anti-rotation tab 170 is configured such that the seal assembly 44 rotates together. The anti-rotation tab 170 may be installed with the blade segment 164 as illustrated in FIG. 11 or FIG. 13, or may be installed at any time during the installation of the seal assembly 44.

The disclosed embodiments may be beneficial in that they may be used to increase cooling efficiency by reducing leakage of cooling fluid 46 from cooling passages within gas turbines 10 while also reducing overall costs of gas turbines 10. For example, the interstage seal assembly 44 may include coverplates 82, 84, 170 that may be employed to improve separation of the cooling fluid 46 from the combustion gases 56. The interstage seal 86 may also direct the combustion gases 56 through the turbine blades 36 and the nozzles 42, which decreases extraneous flow and thus increases efficiency of the gas turbine engine 12. Furthermore, the disclosed embodiments include seals 88 that are attached to the coverplates 82, 84, 170 instead of the blade segments 68, 76, which may enable a decrease in the distance between stages 34 in the turbine engine 12. This decrease in distance translates into an overall shortening of the gas turbine engine 12 and corresponding decrease in cost.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a multi-stage turbine, comprising:

a first turbine stage comprising a first wheel having a plurality of first blade segments spaced circumferentially about the first wheel;

a second turbine stage comprising a second wheel having a plurality of second blade segments spaced circumferentially about the second wheel; and a seal assembly extending axially between the first and second turbine stages, comprising:

a first coverplate coupled to the first turbine stage, wherein the first coverplate comprises a first seal;

a second coverplate coupled to the second turbine stage, wherein the second coverplate comprises a second seal; and an interstage seal comprising a radially outermost surface, wherein the interstage seal is supported by the first coverplate, the second coverplate, or both at the radially outermost surface of the interstage seal, wherein the first coverplate comprises a first seal wing and/or the second coverplate comprises a second seal wing, and the radially outermost surface of the interstage seal contacts the first seal wing and/or the second seal wing.

2. The system of claim 1, wherein the interstage seal comprises one or more seal teeth protruding from the radially outermost surface of the interstage seal and configured to block interstage axial leakage between the first turbine stage and the second turbine stage.

3. The system of claim 1, comprising a forward sealing element, an aft sealing element, or both, wherein the forward sealing element is configured to block a flow of gases between the first coverplate and at least one of the first blade segments, the first wheel, or any combination thereof, and the aft sealing element is configured to block the flow of gases between the second coverplate and at least one of the second blade segments, the second wheel, or any combination thereof.

4. The system of claim 3, wherein the forward sealing element, the aft sealing element, or a combination thereof, is disposed in at least one notch formed in at least one of the first coverplate, the first blade segments, or the first wheel, or any combination thereof.

5. The system of claim 1, wherein the first coverplate comprises a first lip and the second coverplate comprises a second lip, wherein the first lip and second lip are configured to support the interstage seal.

6. The system of claim 1, wherein the interstage seal is integrally formed with the first coverplate or the second coverplate.

7. The system of claim 1, wherein the interstage seal assembly comprises an anti-rotation tab configured to restrict circumferential movement of at least one of the first coverplate with respect to the first turbine stage, the second coverplate with respect to the second turbine stage, or any combination thereof.

8. The system of claim 1, wherein the first seal is disposed at a first radial seal distance that is greater than an outermost radial wheel distance of the interstage seal, and the second seal is disposed at a second radial seal distance that is greater than the outermost radial wheel distance of the interstage seal.

9. The system of claim 1, comprising a nozzle disposed between the first turbine stage and the second turbine stage.

10. The system of claim 1, wherein the interstage seal is configured to engage with the first coverplate and the second coverplate at a radial engagement distance that is greater than a radius of the first wheel, the second wheel, or any combination thereof.

11. The system of claim 1, comprising cooling passages configured to direct a cooling fluid through the first turbine stage, the second turbine stage, or any combination thereof, wherein the first coverplate, the second coverplate, or any combination thereof, are configured to block the cooling fluid from escaping the cooling passages.

12. The system of claim 1, wherein the seal assembly comprises a plurality of seal assemblies arranged circumferentially about the first turbine stage and the second turbine stage.

13. A method of installing a seal assembly between a first turbine stage and a second turbine stage of a multi-stage turbine, comprising:

installing a first coverplate comprising a first seal wing into a first wheel of the first turbine stage, wherein the first seal wing extends axially away from the first coverplate;

installing a first blade segment around a first circumferential rim of the first wheel, wherein the first blade segment is configured to secure the first coverplate;

installing a second coverplate comprising a second seal wing into a second wheel of the second turbine stage, wherein the second seal wing extends axially away from the second coverplate; and installing an interstage seal between the first coverplate and the second coverplate, wherein the interstage seal comprises a radially outermost surface, the interstage seal is supported by the first seal wing with the radial outermost surface at a first radial engagement or the second seal wing with the radial outermost surface at a second radial engagement, and the interstage seal is secured between the first coverplate and the second coverplate; and installing a second blade segment around a second circumferential rim of the second wheel.

14. The method of claim 13, comprising integrally forming the interstage seal with the first coverplate or the second coverplate before installing the interstage seal.

15. The method of claim 13, comprising installing at least one anti-rotation tab configured to restrict circumferential movement of at least one of the first coverplate with respect to the first turbine stage, the second coverplate with respect to the second turbine stage, or any combination thereof.

16. The method of claim 13, wherein installing the first coverplate comprises installing the first coverplate into a recess in the first wheel.

17. A seal assembly for use in a multi-stage turbine, comprising:

a first coverplate configured to be coupled to a first turbine stage of the multi-stage turbine, wherein the first coverplate comprises a first seal;

a second coverplate configured to be coupled to a second turbine stage of the multi-stage turbine, wherein the second coverplate comprises a second seal;

an interstage seal comprising a radially outermost surface having a curved shape along an axial direction, wherein the first coverplate, the second coverplate, or both are configured to support the interstage seal at the radially outermost surface of the interstage seal; and one or more seal wings attached to the first coverplate or the second coverplate, wherein the one or more seal wings extend axially away from the coverplate and are configured to support the interstage seal at a first or a second radial engagement at the radially outermost surface of the interstage seal.

18. The seal assembly of claim 17, wherein the interstage seal is integrally formed with one of the first coverplate or the second coverplate.

19. The system of claim 1, wherein the interstage seal comprises a curved shape from a first end of the interstage seal to a second end of the interstage seal in an axial direction.

20. The system of claim 1, wherein the first coverplate and/or the second coverplate comprises one or more support arms that are cantilever mounted from the coverplate and extends axially away from the coverplate.

* * * * *